US010300591B2

(12) United States Patent
Rejman et al.

(10) Patent No.: US 10,300,591 B2
(45) **Date of Patent: *May 28, 2019**

(54) HAND TOOL MODULE

(71) Applicant: Robert Bosch GmbH, Stuttgart (DE)

(72) Inventors: Marcin Rejman, Waiblingen (DE); Wolf Zahn, Stuttgart (DE); Gunter Flinspach, Leonberg (DE); Alexander Osswald, Stuttgart (DE); Rainer Glauning, Leinfelden-Echterdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 536 days.

This patent is subject to a terminal disclaimer.

(21) Appl. No.: 14/942,080

(22) Filed: Nov. 16, 2015

(65) Prior Publication Data

US 2016/0067859 A1 Mar. 10, 2016

Related U.S. Application Data

(63) Continuation of application No. 13/496,465, filed as application No. PCT/EP2010/062190 on Aug. 20, 2010, now Pat. No. 9,216,505.

(30) Foreign Application Priority Data

Sep. 17, 2009 (DE) ..... 10 2009 029 537

(51) Int. Cl.
*B25F 5/02* (2006.01)

(52) U.S. Cl.
CPC ..... *B25F 5/02* (2013.01)

(58) Field of Classification Search
CPC ..... B25F 5/02
USPC ..... 173/217, 1, 4, 171; 320/114
See application file for complete search history.

(56) References Cited

U.S. PATENT DOCUMENTS

| | | | | |
|---|---|---|---|---|
| 6,502,949 | B1 | 1/2003 | Horiyama et al. | |
| 7,064,520 | B2 | 6/2006 | Heigl et al. | |
| 7,176,656 | B2 | 2/2007 | Feldmann | |
| 7,629,766 | B2 | 12/2009 | Sadow | |
| 2002/0144832 | A1 | 10/2002 | Brandstrom et al. | |
| 2003/0102844 | A1 | 6/2003 | Bailey | |
| 2004/0251041 | A1 | 12/2004 | Grossman | |
| 2005/0082920 | A1 | 4/2005 | Heigl et al. | |
| 2005/0223857 | A1* | 10/2005 | Reynertson | B25B 23/14 81/479 |
| 2005/0280393 | A1* | 12/2005 | Feldmann | B25F 5/00 320/114 |
| 2008/0061734 | A1* | 3/2008 | Roehm | B25F 5/02 320/108 |

(Continued)

FOREIGN PATENT DOCUMENTS

| | | |
|---|---|---|
| CN | 100379528 | 4/2008 |
| CN | 201168806 | 12/2008 |

(Continued)

*Primary Examiner* — Nathaniel C Chukwurah
(74) *Attorney, Agent, or Firm* — Norton Rose Fulbright US LLP; Gerard Messina

(57) ABSTRACT

A hand tool module having an interconnection device, which has an interface. The interconnection device has, in addition to the interface, at least one auxiliary interface, which is provided to bidirectionally exchange at least power at least with one additional hand tool module and/or a hand tool.

23 Claims, 2 Drawing Sheets

(56) References Cited

U.S. PATENT DOCUMENTS

| | | | |
|---|---|---|---|
| 2008/0135272 | A1 | 6/2008 | Wallgren |
| 2009/0237012 | A1 | 9/2009 | Yokoyama et al. |
| 2011/0147031 | A1 | 6/2011 | Matthias et al. |

FOREIGN PATENT DOCUMENTS

| | | |
|---|---|---|
| DE | 4204420 | 8/1993 |
| DE | 10348693 | 5/2005 |
| DE | 102005015654 | 10/2006 |
| DE | 102006042602 | 3/2008 |
| DE | 102007061374 | 6/2009 |
| DE | 102008040061 | 1/2010 |
| EP | 1211030 | 6/2002 |
| EP | 1281486 | 2/2003 |
| EP | 1477272 | 11/2004 |
| FR | 2916320 | 11/2008 |
| WO | WO 2007058596 | 5/2007 |
| WO | WO 2008126685 | 10/2008 |

* cited by examiner

HAND TOOL MODULE

CROSS-REFERENCE TO RELATED APPLICATIONS

The present application is a continuation application of U.S. patent application Ser. No. 13/496,465 filed on Jun. 1, 2012, which is a national phase of International Patent Application No. PCT/EP2010/062190, filed on Aug. 20, 2010, and claims priority to German Patent Application No. 10 2009 029 537.2, filed on Sep. 17, 2009, the contents of each of which are hereby incorporated in the accompanying application by reference in their entireties.

FIELD OF THE INVENTION

The present invention is directed to a hand tool module.

SUMMARY

The present invention is directed to a hand tool module having an interconnection device, which has an interface. The interconnection device has, in addition to the interface, at least one auxiliary interface, which is provided to bidirectionally exchange at least power at least with one additional hand tool module and/or a hand tool. A "hand tool module" is to be understood in particular as a module which is provided to be directly and/or indirectly mechanically fixedly connected to the hand tool in at least one operating state. In particular, the hand tool module is provided to supply the hand tool with power and/or retrofit it with at least one function. An "interface" is to be understood in particular as a device which is provided to directly or indirectly produce an electrical and in particular a mechanical connection to a third device and/or advantageously to the hand tool. The phrase "have an auxiliary interface in addition to the interface" is to be understood in particular to mean that the interconnection device has an interface and an auxiliary interface, which is spatially separated, in particular. The interface and the auxiliary interface are advantageously connectable to different devices. "An additional hand tool module" is to be understood in particular as a second hand tool module, which is advantageous according to the present invention. "Exchanging power bidirectionally" is to be understood in particular to mean that the auxiliary interface is provided to deliver power to a third device, in particular a hand tool module, and receive power from the third device. The term "hand tool" is to be understood to include all appropriate hand tools which are provided in particular to be operated using a battery unit, for example, drills, percussion drills, saws, planes, screwdrivers, mills, grinders, multifunction tools, measuring devices, and/or in particular battery-powered drill/drivers. The hand tool is advantageously designed as a hand-held power tool. "Provided" is to be understood in particular as specially equipped, designed, and/or programmed. As a result of the example embodiment according to the present invention of the hand tool module, an additional hand tool module may be advantageously attached to a hand tool module which is connected to the hand tool. The additional hand tool module may advantageously have a power consumer, a power source, and/or an energy storage as a result of the bidirectional auxiliary interface. The hand tool module may thus supplement the hand tool with various functions particularly flexibly.

In another embodiment, it is proposed that the interface and the auxiliary interface be situated on two different sides, in particular on different sides of a main body, such as a housing of the hand tool module, whereby the hand tool module and at least one additional module may advantageously be stacked. The interface and the auxiliary interface are advantageously situated on diametrically opposing sides of a housing of the hand tool module.

Furthermore, in accordance with an example embodiment of the present invention, at least the interface is provided to produce at least one detachable mechanical connection at least to one additional hand tool module and/or the hand tool. A "detachable mechanical connection" is to be understood in particular as a connection which is detachable by an operator, in particular without tools. The connection is advantageously designed as a catch connection, as a form-fitting insertion connection, as a connection which appears reasonable to those skilled in the art, and/or advantageously as a hook-and-loop connection having conductive areas. With the aid of the detachable mechanical connection to an additional hand tool module and/or the hand tool, it is advantageously achievable that the hand tool module and at least one additional module may advantageously be combined in a particularly comfortable way having a simple design. The interface and the auxiliary interface are preferably designed to be complementary to one another. This means in particular that the interface and the auxiliary interface form two counterparts, which match one another, of a contact means system, in particular a plug connection. Alternatively, a hand tool module having an energy storage preferably has an interface which is non-complementary to the auxiliary interface. This interface is an interface between the hand tool and a hand tool battery. The hand tool module having the energy storage is preferably designed as a conventional hand tool battery having an auxiliary interface according to the present invention. A commercially-available hand tool may thus advantageously be upgraded to form a system according to the present invention.

Furthermore, it is proposed that the interface be provided to bidirectionally exchange at least power at least with one additional hand tool module and/or the hand tool, whereby a particularly flexible system may be obtained, in which multiple hand tool modules may be connected to one another using a simple design.

In addition, it is proposed that the interconnection device have at least one communication channel, which is provided to transmit at least one piece of information. A "communication channel" is preferably to be understood as a bidirectional communication bus in particular, a wireless communication channel which is provided by a communication element, and/or another communication channel which appears reasonable to those skilled in the art. A hand tool module may advantageously exchange pieces of information with another hand tool module and in particular with a hand tool with the aid of the communication module, and thus functions may be flexibly retrofitted particularly advantageously.

In one advantageous embodiment of the present invention, the interface is provided to transmit at least power to the hand tool, at least for a main consumer of the hand tool, whereby the hand tool module may advantageously supplement a hand tool battery with an additional energy storage and/or may replace a hand tool battery. A "main consumer" is to be understood in particular as a means of the hand tool which initiates an execution of a main task, such as in particular a motor and/or a measuring sensor. The interface is advantageously provided to transmit a power of at least 1 W, advantageously at least 5 W, particularly advantageously at least 50 W.

In another embodiment, the hand tool module has an energy storage which is provided to make electrical power available. An "energy storage" is to be understood in particular as a device which stores energy, in particular as chemical energy, in at least one operating state, and makes this energy available as electrical power, as needed. The energy storage advantageously has at least one battery cell, one power capacitor, and/or one fuel cell. The phrase "make electrical power available" is to be understood in particular to mean that the energy storage is provided to supply the hand tool module, another hand tool module, a third device, and/or in particular the hand tool with power at least during an ordinary working process. A hand tool battery may be replaced or supplemented by a hand tool module using a simple design with the aid of the hand tool module having the energy storage. The hand tool module may particularly advantageously also supply an additional hand tool module with electrical power, being electrically separated from a hand tool. Alternatively, the hand tool module could also have an accommodation area for an exchangeable energy storage, in particular for batteries and/or for a conventional hand tool battery.

In addition, it is proposed that the energy storage have a fuel cell, whereby an energy storage having a particularly high energy density may be achieved, the energy storage being able to be charged particularly advantageously.

Furthermore, it is proposed that the interconnection device have, in addition to the interface and the auxiliary interface, a power input, which is provided to receive power from a third device. The power is advantageously provided to charge the energy storage. A third device is to be understood in particular as a charging device. For example, the power input may be designed as a wired power input, as a power input having solar cells, as a power input according to the WildCharge standard, as a mechanical charging device, in particular having a crank or a translation mechanism, and/or as another reasonable power input. The hand tool module may advantageously form at least a part of the charging device as a result of the power input and therefore may flexibly allow particularly advantageous charging methods.

Furthermore, in accordance with an example embodiment of the present invention, the power input is provided to convert inductively transmitted energy into electrical power, whereby a particularly cost-effective and high-performance power input may be implemented, which does not require a conductive electrical external contact. "Inductively transmitted energy" is to be understood in particular as power which is output from a coil, which is situated in a third device in particular, and is received by a coil of the power input. This power transmission preferably functions according to the eCoupled standard. In this case, the power is advantageously sent through an electrically nonconductive material. "Electrical power" is also to be understood in particular as electrically transmitted energy. Alternatively or additionally to the inductively transmitted energy, the power input could also convert capacitive, mechanical, and/or electromagnetic energy into electrical power.

In addition, in accordance with an example embodiment of the present invention, the hand tool module may have a computing unit, which is provided to process at least one parameter. A "computing unit" is to be understood in particular as a controller having a processor, a storage unit, and/or an operating, control, and/or calculation program which is stored in the storage unit. The term "parameter" is to be understood in particular as a data set which contains at least one piece of information. The parameter advantageously describes at least one state of a hand tool module and/or a hand tool. "Processing" is to be understood in particular to mean that the computing unit controls, regulates, displays, measures, or communicates something, and/or executes another activity which appears reasonable to those skilled in the art on the basis of the parameter. The hand tool module may fulfill particularly demanding tasks particularly flexibly using a simple design with the aid of the computing unit.

In an advantageous design of the present invention, it is proposed that the hand tool module have an activation means (element) which is provided to prevent at least one operation of the hand tool. An "activation means" is to be understood in particular as a means having an input unit, in particular for an operator, and a blocking unit, which prevents the operation. The phrase "prevent an operation" is to be understood in particular to mean that the activation means is provided to prevent the execution of the main task of the hand tool. The activation means advantageously communicates with the hand tool for this purpose. Alternatively, the activation means interrupts a power supply of a main consumer of the hand tool and/or of the entire hand tool. The activation means is then advantageously connected to an energy storage or situated in a common hand tool module. The activation means may protect the hand tool module and in particular also the hand tool against unauthorized use and therefore a lower risk of theft may be achieved. In addition, the hand tool module could have a control means, which is provided to prevent an operation of hand tool modules according to the present invention with unpermitted modules and/or hand tools, for example, by mechanical coding, coding of a communication, and/or, advantageously, invisible coding using magnets. A particularly secure operation is possible as a result of the control means.

In another example embodiment, the interconnection device may have a power output in addition to the interface and in addition to the auxiliary interface, which is provided to supply a third device with electrical power, whereby the hand tool module may advantageously be used as a flexible, mobile power source. The power output could provide an adjustable voltage and/or could provide a specific voltage to an advantageous interface, for example, a USB interface or portable power supply.

Furthermore, the hand tool module may have an output unit, which is provided to output at least one piece of information to an operator. The hand tool module advantageously may have an input unit, which is provided to receive a piece of information from an operator. An "output unit" is to be understood in particular as a display screen, a loudspeaker, or a headphone output, and/or another output unit which appears reasonable to those skilled in the art. An "input unit" is to be understood in particular as a keyboard, a touch screen, a microphone, and/or another input unit which appears reasonable to those skilled in the art. Thanks to the output unit, the hand tool module may advantageously be used during work as an information source for pieces of information of the hand tool, for pieces of information of a hand tool module, and/or for stored pieces of information and may thus allow particularly comfortable work.

Furthermore, the hand tool module may have at least one communication device, which is provided to communicate wirelessly with at least one unit, whereby the hand tool module may advantageously be networked and may exchange pieces of information, in particular of the hand tool, with a documentation system and with other points of a network, such as the Internet. The phrase "communicate wirelessly" is to be understood in particular to mean that the communication device is provided to transmit pieces of information via a nonphysical information carrier, such as in particular via a wireless connection.

In addition, the hand tool module may have at least one mounting device, which is provided to removably mechanically fasten at least one third means without tools, whereby additional work material may be fastened particularly comfortably and flexibly to the hand tool module.

Furthermore, the present invention is directed to a hand tool termination module having an interface, which is provided to be connected to an auxiliary interface of a hand tool module. A "hand tool termination module" is to be understood in particular as a module which is provided to solely be connected to a hand tool module. As a result of the hand tool termination module, a side of the hand tool termination module facing away from the interface may advantageously be used for a function, for example, for a display, for a keyboard, as a power entry surface for inductively transmitted energy, and/or for another reasonable function.

BRIEF DESCRIPTION OF THE DRAWINGS

Further advantages of the present invention are described below. Two exemplary embodiments of the present invention are shown in the figures. The figures and the description below contain numerous features in combination. The features may be considered individually or combined into other reasonable combinations.

DETAILED DESCRIPTION OF EXAMPLE EMBODIMENTS

Figure 1:
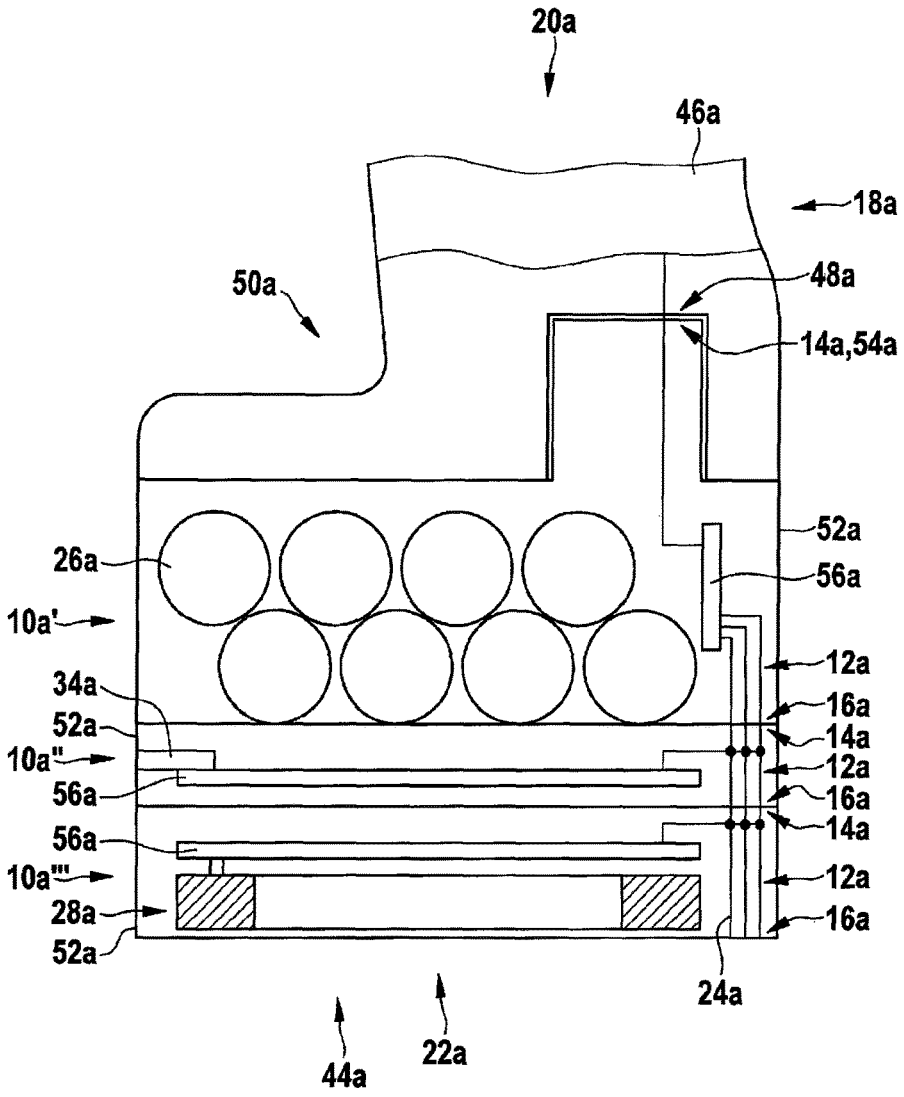
FIG. 1 shows a schematic view of three hand tool modules according to an example embodiment of the present invention having an energy storage, a power output, and a power input.

FIG. 1 shows a system 44*a* having a hand tool 18*a* and three hand tool modules 10*a*. Hand tool 18*a* is designed as a battery-powered handheld power tool, specifically as a battery-powered drill/driver. Hand tool 18*a* has a pistol-shaped housing (not shown in greater detail) having a handle 46*a* and a battery interface 48*a*. Battery interface 48*a* is situated on an end 50*a* of hand tool 18*a* located on handle 46*a*. Battery interface 48*a* accepts electrical power, which is required for operation, from hand tool modules 10*a*.

Hand tool modules 10*a* each have an interconnection device 12*a* having an interface 14*a*. In addition, interconnection devices 12*a* each have an auxiliary interface 16*a* in addition to interfaces 14*a*. Auxiliary interfaces 16*a* bidirectionally exchange power, in appropriate operating states and with appropriate interconnection, with one of the other hand tool modules 10*a*, more precisely with their auxiliary interfaces 16*a*, and/or with hand tool 18*a*. Fundamentally, all hand tool modules 10*a* may bidirectionally exchange power and may be situated in any desired sequence.

Hand tool module 10*a*", which is situated between the two other hand tool modules 10*a*', 10*a*"', outputs power to hand tool module 10*a*', which is connected to hand tool 18*a*, during charging operation. Hand tool module 10*a*', which is connected to hand tool 18*a*, accepts this power. Interface 14*a* of hand tool module 10*a*', which is connected to hand tool 18*a*, transmits power for a motor (not shown in greater detail) of hand tool 18*a* to hand tool 18*a* during a working process.

Hand tool modules 10*a* each have a housing 52*a*, in which interconnection device 12*a* is largely situated. Interfaces 14*a* and auxiliary interfaces 16*a* are situated on each hand tool module 10*a* on two different, diametrically opposing sides 20*a*, 22*a* of housing 52*a*.

Interface 14*a* of hand tool module 10*a*, which is connected to hand tool 18*a*, produces a mechanical and electrical connection, which is detachable without tools, to hand tool 18*a*. Interface 14*a* is designed as a hand tool interface 54*a*. Interfaces 14*a* of the other two hand tool modules 10*a* are designed to be complementary to auxiliary interfaces 16*a* of hand tool modules 10*a*.

Interconnection devices 12*a* each have a communication channel 24*a*, which is guided in a wired manner from interface 14*a* to auxiliary interface 16*a*. In an operation-ready state, communication channels 24*a* of various hand tool modules 10*a* are connected to one another. Hand tool modules 10*a* may transmit pieces of information and exchange them with one another via communication channels 24*a*.

Hand tool module 10*a*', which is connected to hand tool 18*a*, has an energy storage 26*a*. Energy storage 26*a* makes electrical power available and supplies hand tool 18*a* with this electrical power during operation of hand tool 18*a*. Energy storage 26*a* is designed as a lithium battery. Multiple hand tool modules each having an energy storage, in particular using different technologies, may also be interconnected, and the running time and/or a performance of a system 44*a* may thus be extended.

Interconnection device 12*a* of concentrically-situated hand tool module 10*a*" has a power output 34*a* in addition to interface 14*a* and auxiliary interface 16*a*. Power output 34*a* supplies a third device (not shown in greater detail), which is connected to power output 34*a*, with electrical power from energy storage 26*a*. Power output 34*a* is designed as a USB interface. Power output 34*a* may thus supply a large number of different device types with electrical power.

Interconnection device 12*a* of hand tool module 10*a*"', which is situated outermost, has, in addition to interface 14*a* and auxiliary interface 16*a*, a power input 28*a*. Power input 28*a* accepts power from a charging device (not shown in greater detail) during a charging procedure. The charging device converts electrical power into an inductive field with the aid of a coil. Power input 28*a* converts this inductively transmitted energy back into electrical power. Middle hand tool module 10*a*" relays the power to hand tool module 10*a*' having energy storage 26*a*, which charges energy storage 26*a* using the power. Hand tool module 10*a*"', which is situated outermost, could be designed as a hand tool termination module.

The three hand tool modules 10*a* each have electronics 56*a*, which monitor or control a function of hand tool module 10*a*, i.e., a charging procedure, a power output, a power reception, a communication with the charging device, and other functions.

Electronics 56*a* may communicate with one another via communication channels 24*a*. A reasonable protocol may be used for this purpose.

Figure 2:
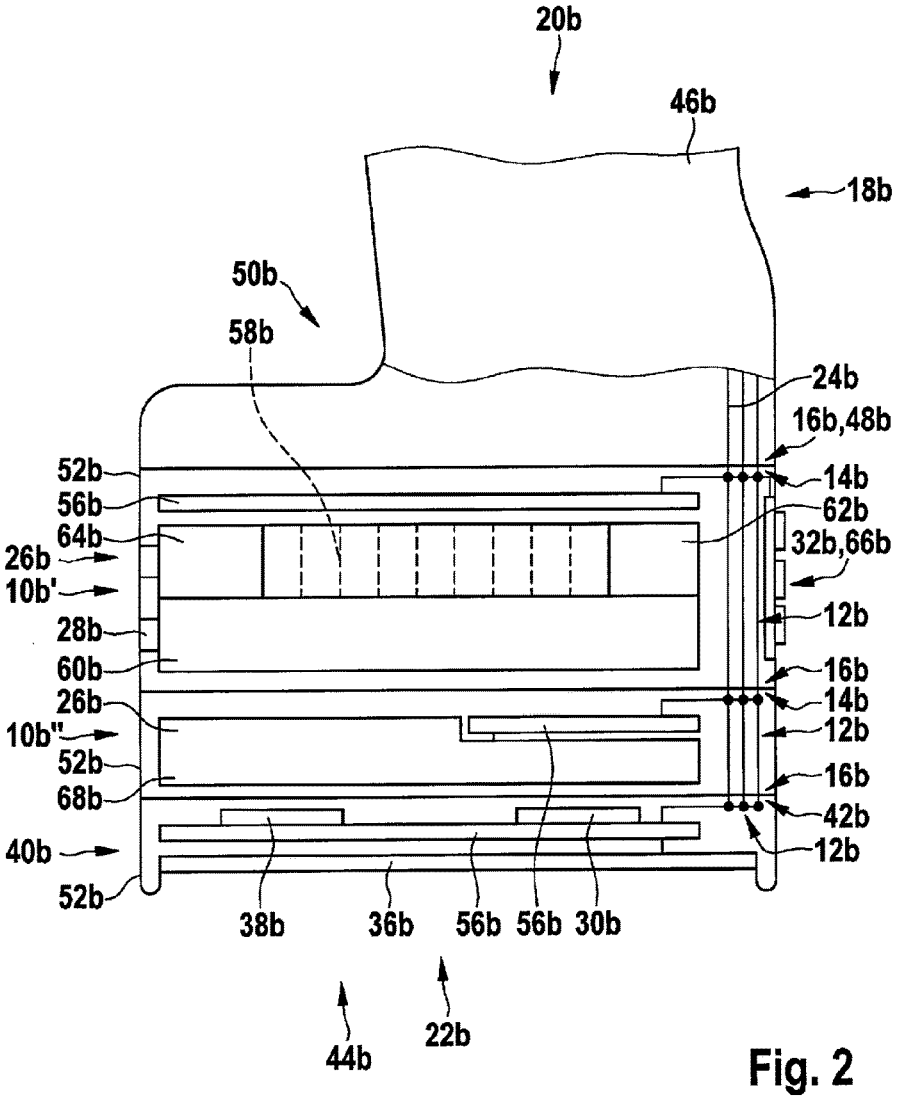
FIG. 2 shows a schematic view of three hand tool modules according to the example embodiment of the present invention, two of which each having one energy storage and one of which having an output unit and a communication device.

Another exemplary embodiment of the present invention is shown in FIG. 2. To differentiate the exemplary embodiments, letter a in the reference numerals of the exemplary embodiment in FIG. 1 is replaced by letter b in the reference numerals of the exemplary embodiment in FIG. 2. The following description is generally restricted to the differences between the exemplary embodiments, reference possibly being made to the description of the other exemplary embodiments, in particular in FIG. 1, with respect to identical components, features, and functions.

FIG. 2 shows a system 44*b* made of a hand tool 18*b*, two hand tool modules 10*b*, and a hand tool termination module 40*b*. Hand tool modules 10*b* and hand tool termination module 40*b* each have an interconnection device 12*b* having an interface 14*b*. Interconnection devices 12*b* of hand tool modules 10*b* each have, in addition to interface 14*b*, an auxiliary interface 16*b*. Auxiliary interfaces 16*b* bidirectionally exchange power with an additional hand tool module 10*b* and/or with hand tool 18*b* during operation if interconnected appropriately. Hand tool 18*b* has a battery interface 48*b*, which is designed as an auxiliary interface 16*b*.

Hand tool module 10*b*', which is directly connected to hand tool 18*b*, has an energy storage 26*b* having a fuel cell 58*b*, a fuel tank 60*b*, a fuel pump 62*b*, and an air pump 64*b*. Fuel pump 62*b* and air pump 64*b* supply fuel cell 58*b* with a liquid or gaseous fuel and air oxygen. Fuel cell 58*b* generates electrical power therefrom. Using this power, fuel cell 58*b* may advantageously supply with power a hand tool, which continuously requires a low power, such as a handheld measuring device. Fuel tank 60*b* may be filled up via a power input 28*b*.

Furthermore, hand tool module 10*b*', which is directly connected to hand tool 18*b*, has an activation means (element) 32*b* having a keyboard 66*b*. Before operation, an operator (not shown in greater detail), must input a PIN into keyboard 66*b*. If the operator cannot input the correct PIN, activation means 32*b* prevents operation of hand tool 18*b*, in that fuel cell 58*b* does not provide power. Furthermore, activation means 32*b* may have a securing arrangement (not shown in greater detail), which prevents easy disconnection of hand tool module 10*b* from hand tool 18*b*.

Hand tool module 10*b*', which is directly connected to hand tool 18*b*, is directly connected to a concentrically-situated hand tool module 10*b*". This hand tool module 10*b*" has an energy storage 26*b* having capacitors 68*b*. Capacitors 68*b*, together with fuel cell 58*b*, supply hand tool 18*b* with power during a working process. Between two working processes, fuel cell 58*b* charges capacitors 68*b*. Capacitors 68*b* have a low internal resistance, resulting in a particularly large amount of power being available during a working process.

Hand tool termination module 40*b* is exclusively directly connected to concentrically-situated hand tool module 10*b*". It has an interface 42*b*, which is designed to be complementary to auxiliary interfaces 16*b* of hand tool 18*b*. Depending on the function of hand tool termination module 40*b*, interface 14*b* could accept power, e.g., for a power output, output power, e.g., from a power input, or bidirectionally exchange power, e.g., to charge and discharge an energy storage.

Hand tool termination module 40*b* is designed as a documentation module. Hand tool termination module 40*b* exchanges parameters about working processes with hand tool 18*b* via a communication channel of hand tool modules 10*b*. For this purpose, hand tool termination module has a computing unit 30*b* and a communication device 38*b*. Computing unit 30*b* stores the parameters, processes the parameters, and controls the communication. Communication device 38*b* wirelessly communicates the parameters to a documentation system for a quantity control. The operator may monitor the parameters on an output unit 36*b*. Output unit 36*b* is designed as a touch screen and is simultaneously used as a controller. A hand tool module could also have the functionalities and features of hand tool termination module 40*b*.

Alternatively or additionally to the described hand tool modules and the hand tool termination module, other functions are also possible. For example, a hand tool module and/or a hand tool termination module could have an illumination means, a radio, a dictation device, a pager, a contact charging means, a random-access memory, a charging device, a mobile communication system, e.g., to order consumables, a display for notes and/or work plans, an insert tool holder, a magnet holder, a solar charging device, a measuring tool, an AC voltage input, and/or a wired auxiliary battery, e.g., having a belt fastener.

What is claimed is:

1. A hand tool module comprising:

an interconnection device which has a first interface, at least one auxiliary interface, and at least one power output situated between the first interface and the at least one auxiliary interface, wherein the first interface provides a detachable mechanical connection to a hand tool, wherein the first interface and the auxiliary interface are situated on two different sides of the interconnection device and are embodied as complementary interfaces, wherein the at least one power output is configured to supply a third device, which is connectable to the power output, with electrical power.

2. The hand tool module as recited in claim 1, wherein the first interface is configured to bidirectionally exchange power with at least one of an additional hand tool module and the hand tool.

3. The hand tool module as recited in claim 2, further comprising:

an energy storage configured to supply electrical power to the at least one of the additional hand tool module and the hand tool.

4. The hand tool module as recited in claim 3, wherein the energy storage is embodied as a lithium based battery pack.

5. The hand tool module as recited in claim 3, wherein the energy storage is embodied as a fuel cell.

6. The hand tool module as recited in claim 3, wherein the energy storage includes at least one capacitor.

7. The hand tool module as recited in claim 1, wherein the auxiliary interface has at least one communication channel to transmit at least one piece of information.

8. The hand tool module as recited in claim 7, wherein the communication channel is a wireless communication channel.

9. The hand tool module as recited in claim 7, wherein the communication channel is a wired communication channel.

10. The hand tool module as recited in claim 7, wherein the communication channel is a bidirectional communication bus.

11. The hand tool module as recited in claim 1, wherein the first interface is configured to transmit power to the hand tool for one main consumer of the hand tool.

12. The hand tool module as recited in claim 1, wherein the interconnection device further comprises:

a power input to receive power from a third device.

13. The hand tool module as recited in claim 12, wherein the power input is configured to convert inductively transmitted energy into electrical power.

14. The hand tool module as recited in claim 1, further comprising:

a computing unit to process at least one parameter.

15. The hand tool module as recited in claim 14, wherein the computing unit is configured to at least one of store operating parameters, process operating parameters and control communication of the operating parameters via a communication device of the hand tool module.

16. The hand tool module as recited in claim 15, wherein the output unit is embodied as a touch screen.

17. The hand tool module as recited in claim 1, further comprising:

an output unit to output at least one operating parameter of the hand tool to an operator.

18. The hand tool module as recited in claim 17, wherein the output unit is further configured to control at least one of a hand tool module and the hand tool.

19. The hand tool module as recited in claim 17, wherein the output unit further includes a communication device configured to wirelessly communicate at least one operating parameter to a documentation device.

20. The hand tool module as recited in claim 1, further comprising:

at least one communication device to wirelessly communicate with at least one unit.

21. The hand tool module as recited in claim 1, wherein the power output is embodied as a USB interface.

22. The hand tool module as recited in claim 1, wherein the auxiliary interface is configured to bidirectionally exchange power with at least one of an additional hand tool module and the hand tool.

23. A system, comprising:

a hand tool; and a hand tool module comprising:

an interconnection device which has a first interface, at least one auxiliary interface, and at least one power output situated between the first interface and the at least one auxiliary interface, wherein the first interface provides a detachable mechanical connection to the hand tool, wherein the first interface and the auxiliary interface are situated on two different sides of the interconnection device and are embodied as complementary interfaces, wherein the at least one power output is configured to supply a third device, which is connectable to the power output, with electrical power.

* * * * *